United States Patent [19]

Piper

[11] 4,243,989

[45] Jan. 6, 1981

[54] VEHICLE ANTENNA

[75] Inventor: Bert W. Piper, 36051 Goddard Rd., Romulus, Mich. 48174

[73] Assignee: Bert William Piper, Belleville, Mich.

[21] Appl. No.: 88,831

[22] Filed: Oct. 29, 1979

[51] Int. Cl.[3] ..... H01Q 1/20; H01Q 1/32

[52] U.S. Cl. ..... 343/715; 343/882

[58] Field of Search ..... 343/715, 880, 882, 883, 343/900

[56] References Cited

U.S. PATENT DOCUMENTS

| | | | |
|---|---|---|---|
| 4,037,229 | 7/1977 | Dunk | 343/715 |
| 4,173,761 | 11/1979 | Liautaud | 343/715 |

*Primary Examiner*—Eli Lieberman

*Attorney, Agent, or Firm*—Barnes, Kisselle, Raisch & Choate

[57] ABSTRACT

A vehicle antenna rod has a ball at its lower end mounted for universal pivoting movement on a base. The ball is retained on the base by a cap through which the antenna rod extends. The cap is freely rotatable in a horizontal plane on the base and has a plurality of circumferentially spaced slots extending down from its upper end for enabling the antenna rod to swivel to a generally horizontal position closely adjacent the support surface on which the base is mounted.

16 Claims, 4 Drawing Figures

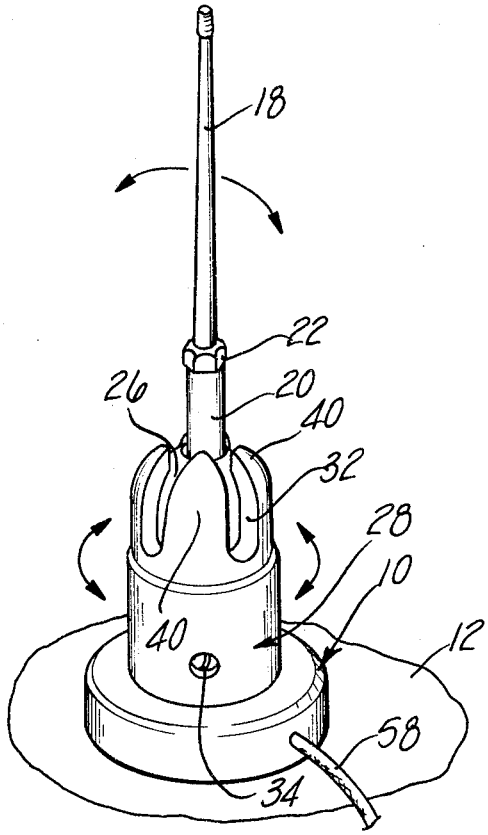
Fig-1
Fig-3
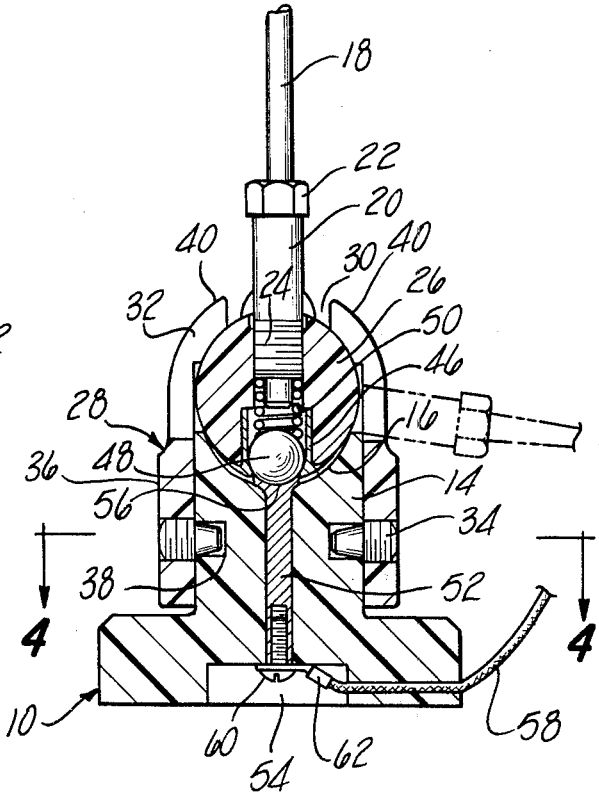
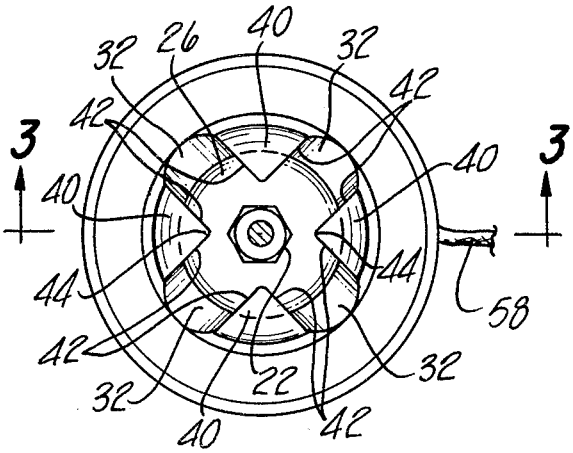
Fig-2
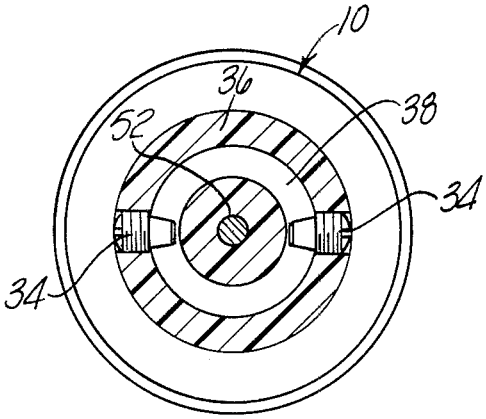
Fig-4

VEHICLE ANTENNA

This invention relates to a vehicle antenna and, more particularly, to a vehicle antenna of the collapsible type.

Most collapsible vehicle antennas are the type which comprise a plurality of telescopically engaged sections which are either manually or electrically extended and collapsed. Some antennas are pivotally supported on a mounting base so that they will automatically pivot forwardly or rearwardly to a collapsed position when encountering an obstruction. Other antennas are mounted on a base for universal pivoting movement to a somewhat limited extent.

The present invention has for its primary object the provision of a vehicle antenna which is supported for universal pivotal movement to a fully collapsed position when it encounters an obstruction. As used herein, the term "fully collapsed" designates a position wherein the antenna extends generally horizontally closely adjacent the surface on which it is mounted.

A further object of this invention is to provide an antenna of the type described which is of relatively simple, rigid and economical construction.

Other objects, features and advantages of the present invention will become apparent from the following description and accompanying drawing, in which:

FIG. 1 is a perspective view of the vehicle antenna of the present invention;

FIG. 2 is a top view of the antenna shown in FIG. 1;

FIG. 3 is a sectional view along the line 3—3 in FIG. 2; and

FIG. 4 is a sectional view along the line 4—4 in FIG. 3.

The antenna of the present invention comprises a base 10 which is adapted to be secured in any suitable manner on a vehicle, such as on the roof 12 thereof. Base 10 has an upstanding central portion 14 of cylindrical cross section. The portion 14 is formed with a concave seat 16 at its upper end. Seat 16 is formed as a segment of a hemisphere, that is, the seat 16 comprises a socket the size of which is less than half a sphere.

The antenna rod is designated 18 and is formed with a cylindrical portion 20 at its lower end. The upper end of portion 20 is hexagonally shaped as at 22. The lower end of the portion 20 is threaded as at 24 for securing it to a ball 26. Ball 26 is seated in socket 16 and is retained therein by a cap 28.

Cap 28 has a central opening 30 at its upper end and a plurality of vertical slots 32 extending downwardly from the periphery of opening 30. In the embodiment illustrated four such slots 32 are provided and are spaced equally around the periphery of the cap. The cap is rotatably journalled on base 10 by means of a pair of dog screws 34 which are threaded through the annular skirt 36 at the lower end of cap 28. The inner ends of screws 34 are slidably retained within a circumferential groove 38 extending around the upstanding cylindrical portion 14 of base 10. The fit between the skirt 36 of cap 28 and the cylindrical portion 14 of base 10 and the fit between screws 34 and the groove 38 is such that the cap 28 is freely rotatable about the central vertical axis on base 10.

As is best seen in FIG. 2, the four slots 32 define therebetween four fingers 40; the upper ends of fingers 40 are of arcuate shape and extend radially inwardly over the upper portion of ball 26. The upper end of each finger is defined by a pair of converging surfaces 42 which intersect at a sharp edge or preferably with a very small radius 44. The width of each slot 32 is at least slightly greater than the diameter of the cylindrical portion 20 at the lower end of antenna rod 18.

Diametrically opposite the cylindrical portion 20 of antenna rod 18 there is fixed in ball 26 a metal tubular ferrule 46 and within ferrule 46 there is arranged a ball detent 48. A spring 50 is compressed between the lower end of the cylindrical portion 20 and the top side of ball 48. The lower end of ferrule 46 is crimped inwardly slightly to prevent the ball 48 from projecting outwardly of the ferrule 46 beyond a predetermined extent. The force exerted by spring 50 on ball 48 can be varied as desired by threading the cylindrical portion 20 of the antenna rod into or out of ball 26. This is facilitated by the hexagonally shaped portion 22. A detent retainer stud 52 extends upwardly from a central recess 54 at the lower end of base 10. The upper end of stud 52 terminates in a small retainer socket 56 at the central portion of socket 16 and in which ball 48 is biased to seat when the antenna rod 18 extends vertically. Base 10 has a radial passageway at its lower end for accommodating a wire conductor 58. Conductor 58 is secured to the lower end of stud 52 by a screw 60 extending through a terminal 62 at the end of wire 58. When antenna rod 18 extends vertically upwardly it is electrically connected to conductor 58 by stud 52, ball 48 and spring 50.

The operation of the antenna is believed to be obvious. In the event the antenna encounters an obstruction in any direction, it will be readily collapsed from the upright position to the collapsed position shown in broken lines in FIG. 3. As is shown in FIG. 3 the lower ends of slots 32 terminate at a level substantially below the center of base 26. Thus in the collapsed position rod 18 is inclined slightly downwardly from the horizontal and extends closely adjacent the support surface of the vehicle on which the antenna is mounted. When the antenna is deflected, if the cylindrical portion 20 is aligned with one of the slots 32, the antenna simply pivots about the center of ball 26 as an axis and the cylindrical portion 20 swings downwardly into the slot with which it is aligned. On the other hand, if the cylindrical portion 20 of the antenna rod is aligned with the end of one of the fingers 40, then, as the cylindrical portion 20 engages the finger 40, the cap member 28 will be cammed in one direction or the other, depending upon which of the two cam faces 42 of the finger it engages. This is insured because of the very small radius surface 44.

Thus, if a vehicle having an antenna according to the present invention mounted on the roof thereof is conveyed through an automatic car wash and the antenna rod 18 encounters an obstruction such as a rotating scrubbing brush, it will be immediately deflected to the collapsed position shown in broken lines in FIG. 3. It will be appreciated that even after the antenna rod is pivoted to the collapsed position, if it encounters a further obstruction, such as a scrubbing brush rotating on a vertical axis, the cap 28 will be rotated on base 10 to permit the vehicle to pass the obstruction without any damage to the antenna.

The amount of force required to tilt the antenna to the collapsed position can be adjusted to a desired value by threading the portion 20 into and out of base 26. Ball 26, base 10 and cap 28 are preferably molded of a low friction plastic resin such as nylon.

I claim:

1. A vehicle antenna comprising a base member adapted to be mounted on a support surface of a vehicle, said base member having an upwardly concave socket at its upper end defined generally by a segment of a hemisphere, an antenna rod having a generally spherical ball member fixedly attached to its lower end, said ball member having a diameter corresponding generally to the diameter of said hemisphere and being seated in said socket, a cap overlying said ball member and having an annular skirt extending downwardly past said socket, means connecting said cap with said base and permitting said cap to rotate in a horizontal plane around a vertical axis concentric with said ball, said cap having a central opening at its upper end through which the antenna rod extends, said opening having a transverse dimension less than the diameter of said hemisphere, said cap having a plurality of circumferentially spaced slots extending downwardly from the periphery of said opening to a level below the center of said ball member, said slots having a width sufficient to accommodate the portion of the antenna rod adjacent its connection with said ball member and means acting between said ball member and said seat for yieldably retaining the antenna rod in a position extending vertically upwardly from said base.

2. A vehicle antenna as called for in claim 1 wherein said slots define a plurality of circumferentially spaced fingers extending upwardly on said skirt to said opening at the upper end of said cap, the upper ends of said fingers comprising generally radially extending cam surfaces for rotating the cap about said vertical axis when the antenna rod is laterally deflected while oriented in a position out of alignment with said slots.

3. A vehicle antenna as called for in claim 2 wherein the upper end of each finger comprises a pair of surfaces converging toward the center of said opening.

4. A vehicle antenna as called for in claim 2 wherein said converging surfaces on each finger intersect at an edge of very small curvature.

5. A vehicle antenna as called for in claim 3 wherein the portion of the antenna rod adjacent said ball is of cylindrical shape and said radially innermost end portion of each finger comprises an arcuate surface having a radius substantially smaller than the radius of said cylindrical portion of the antenna rod.

6. A vehicle antenna as called for in claim 1 wherein said yieldable means comprises a detent in one of said base and ball members and a retainer in the other member engageable with said detent, said detent and retainer being aligned axially with the antenna rod when the rod extends vertically upwardly from said base and means yieldably biasing said detent into engagement with the retainer when the rod extends vertically upwardly from said base.

7. A vehicle antenna as called for in claim 6 wherein said antenna rod is electrically connected to one of said detent and retainer and means for connecting an electrical conductor to the other of said detent and retainer.

8. A vehicle antenna as called for in claim 1 wherein said yieldable means comprises a detent in said ball member aligned axially with the antenna rod and biased radially outwardly and a retainer located centrally in said socket and engagable with said detent to yieldably resist tilting of the antenna rod.

9. A vehicle antenna as called for in claim 8 wherein said detent has a generally spherical outer end engagable with said retainer.

10. A vehicle antenna as called for in claim 9 including a compression spring biasing said detent radially outwardly of said ball member.

11. A vehicle antenna as called for in claim 10 wherein the lower end of said antenna rod is threaded into said ball member, said spring extending between the lower end of said rod and said detent whereby the biasing force of said spring on the detent can be varied by threaded adjustment of the antenna rod in said ball member.

12. A vehicle antenna as called for in claim 10 wherein said spring forms an electrical conductor extending between said antenna rod and said detent, said detent and retainer comprising electrical conductors and means for connecting a wire conductor with said retainer.

13. A vehicle antenna as called for in claim 12 wherein said retainer comprises a metal stud extending downwardly from said socket to the lower end portion of said base, said base having a radial passageway adjacent its lower end to accommodate said wire conductor.

14. A vehicle antenna as called for in claim 1 wherein the portion of the base member which is overlapped by said skirt is of cylindrical shape and has a circumferentially extending groove therein, said skirt having a stud means thereon extending radially into said groove for permitting said cap to rotate on said base member.

15. A vehicle antenna as called for in claim 1 wherein said base member, said ball member and said cap are formed of a plastic resin.

16. A vehicle antenna as called for in claim 1 wherein said base member, said ball member and said cap are molded from a plastic resin.

* * * * *